United States Patent [19]

van der Lely et al.

[11] 3,973,680

[45] Aug. 10, 1976

[54] DEVICES FOR ERECTING A BUILDING FROM PREFABRICATED SECTIONS

[76] Inventors: Cornelis van der Lely, 7, Bruschenrain, Zug; Hendricus Jacobus Cornelis Nieuwenhoven, Hirssattelweg, 6340 Baar, both of Switzerland

[22] Filed: May 27, 1975

[21] Appl. No.: 580,979

Related U.S. Application Data

[63] Continuation of Ser. No. 413,373, Nov. 6, 1973, abandoned.

[30] Foreign Application Priority Data

Nov. 7, 1972 Netherlands ..... 7215004

[52] U.S. Cl. ..... 212/76; 212/120; 212/117; 52/747

[51] Int. Cl.[2] ..... E04G 23/06; B66C 21/00

[58] Field of Search ..... 52/747; 212/79, 117, 212/83, 119, 76, 120

[56] References Cited

UNITED STATES PATENTS

| | | | |
|---|---|---|---|
| 787,569 | 4/1905 | French | 212/79 |
| 844,386 | 2/1907 | McCormick et al. | 212/117 |
| 955,940 | 4/1910 | Bowcher | 212/83 |
| 1,438,453 | 12/1922 | Miller | 212/83 |
| 2,364,851 | 12/1944 | Johansen | 52/117 |
| 2,421,913 | 6/1947 | Stoddard | 52/117 |
| 3,083,839 | 4/1963 | McIntyre | 212/122 |
| 3,116,838 | 1/1964 | Park et al. | 212/119 |
| 3,333,713 | 8/1967 | Cruciani | 212/76 |

FOREIGN PATENTS OR APPLICATIONS

| | | | |
|---|---|---|---|
| 546,724 | 9/1922 | France | 212/76 |
| 521,292 | 3/1921 | France | 52/747 |
| 91,653 | 10/1895 | Germany | 212/120 |
| 64,153 | 3/1913 | Switzerland | 52/747 |
| 766,124 | 1/1957 | United Kingdom | 212/117 |

*Primary Examiner*—Ernest R. Purser
*Assistant Examiner*—James L. Ridgill, Jr.
*Attorney, Agent, or Firm*—Mason, Mason & Albright

[57] ABSTRACT

Apparatus for erecting a prefabricated section building having two masts centered on either side of its foundation, the sections transported to loading areas adjacent and between each mast and the foundation. Cables connect the masts and support two independently operable trolleys between the masts, a hoist on each trolley including a cable connects via a yoke to a section in the loading area and lifts same vertically from a truck therein to at least the story being assembled, and then moves it horizontally to immediately above its ultimate location where it is lowered. A nearby operator, by remote control depending from the trolley, controls its movements to position it precisely, such control being of winches connected to cables for moving the hoist, and trolleys. This operator also communicates with the ground by telephone or radio. Each mast has three stays. To raise it, it is laid out horizontally with the cables and stays positioned. A vertical support is connected to the stay leading towards direction the mast is raised. By pulling this support in a rotary downward motion, each mast is raised and then secured. The mast's relative orientation with the building to be erected is such that each section is maintained in desired geometric orientation commencing with positioning of the truck delivering same until placed in the building, the only movements being horizontal and vertical without movement fore and aft, twisting or turning except minor adjustments incident to its final correct positioning.

11 Claims, 9 Drawing Figures

DEVICES FOR ERECTING A BUILDING FROM PREFABRICATED SECTIONS

This is a continuation of application Ser. No. 413,373 filed Nov. 6, 1973, now abandoned.

This invention relates to devices for erecting a building from prefabricated sections, and also to a method of making such devices ready for use.

According to one aspect of the present invention there is provided a device for erecting a building from prefabricated sections, the device comprising at least one guide extending, in use, in the direction of length of and near the centre of the building to be erected above the foundation of the building so that with the aid of the guide the sections can be moved to their places.

According to another aspect of the present invention there is provided a method of making ready for use a device as just defined, wherein after feet of supports for the guide are secured in place, the guide is arranged between the supports and various stays are fastened to the supports; at least the stays in line with the guide, viewed on plan, are stretched, and the supports are moved upwards about their pivoting feet with the aid of one of the stays that is a side stay.

Figure 1:
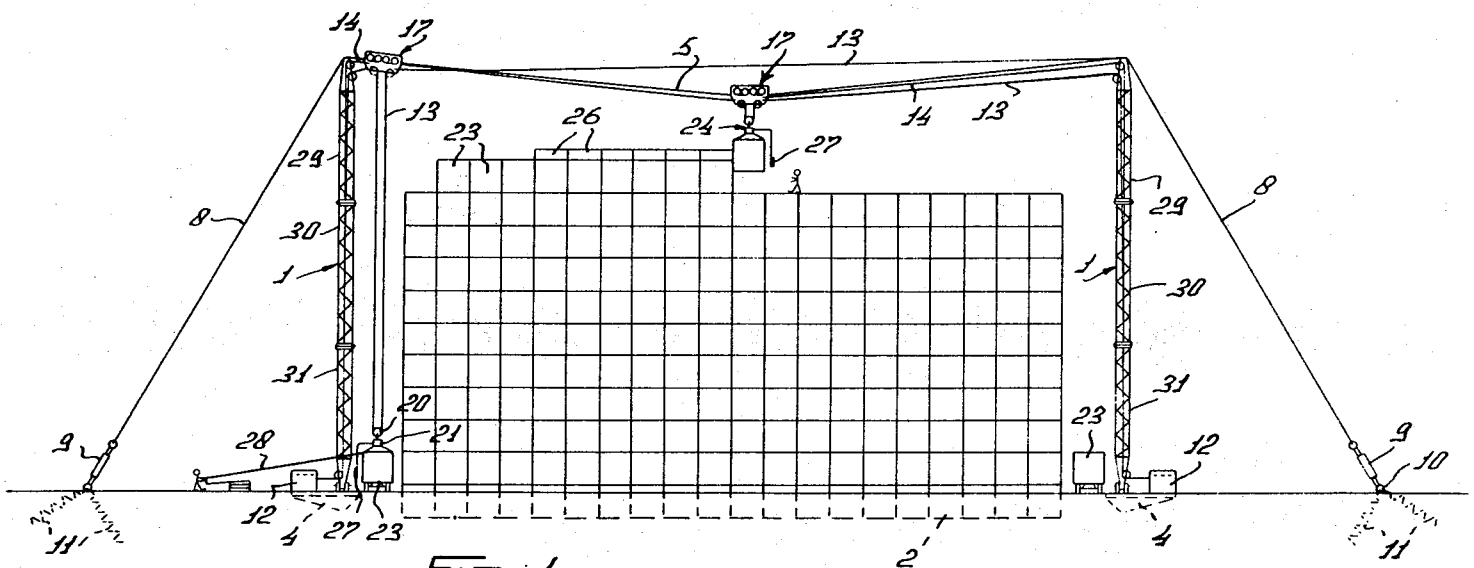
Figure 9:
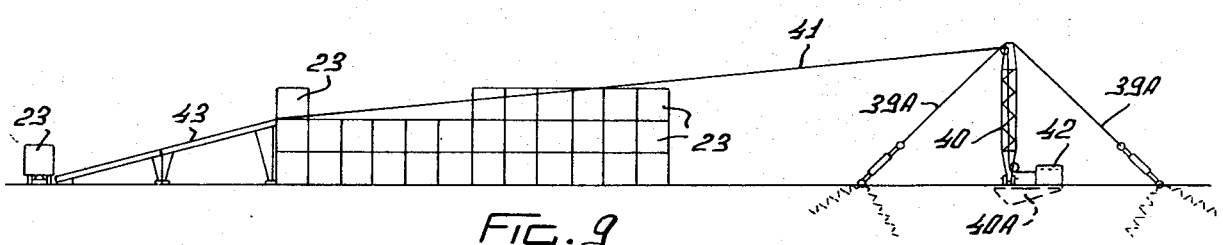
Figure 2:
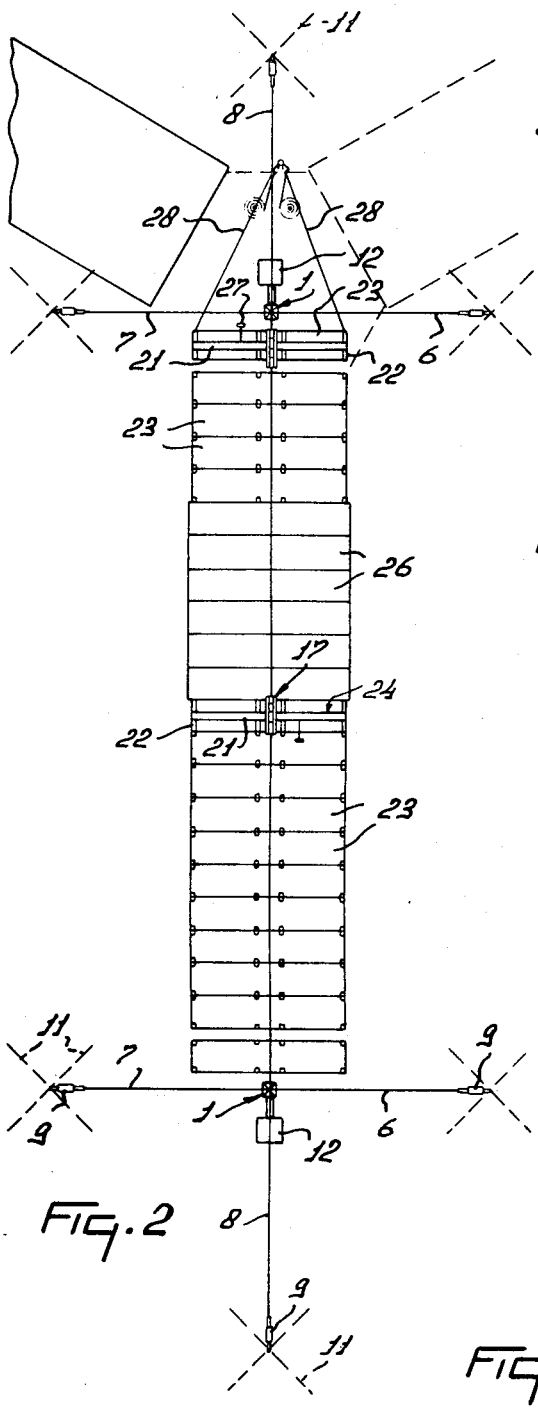
Figure 3:
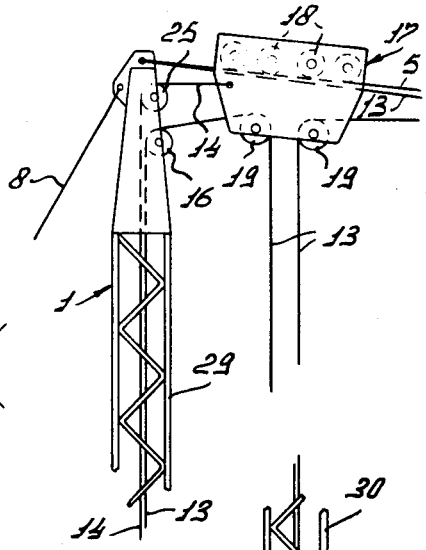
Figure 4:
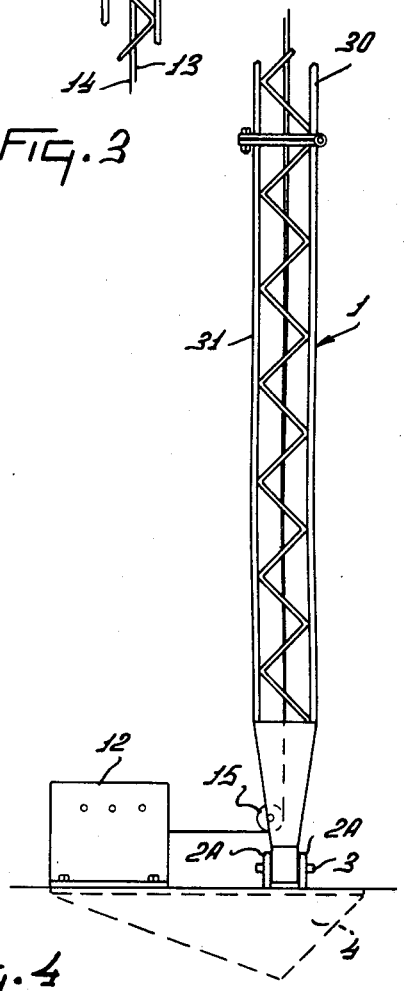
Figure 5:
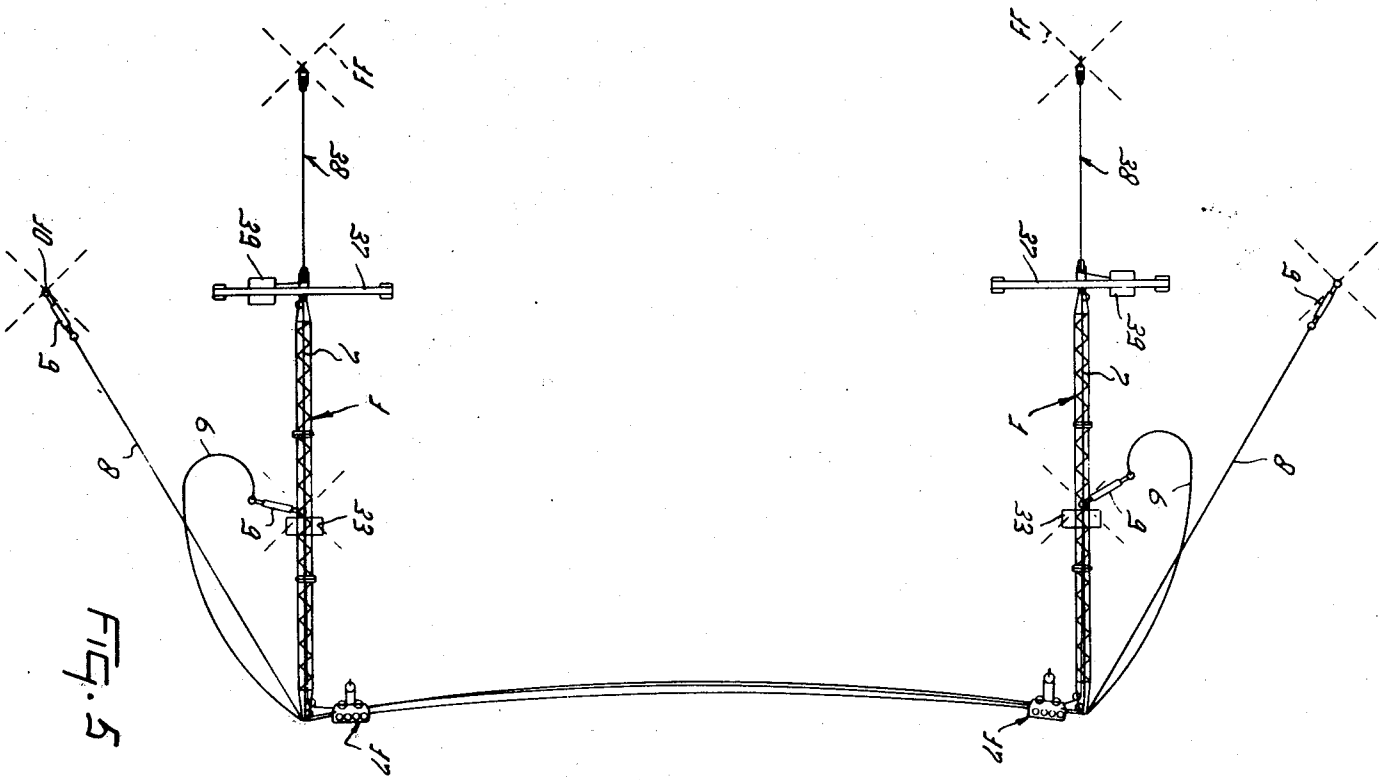
Figure 6:
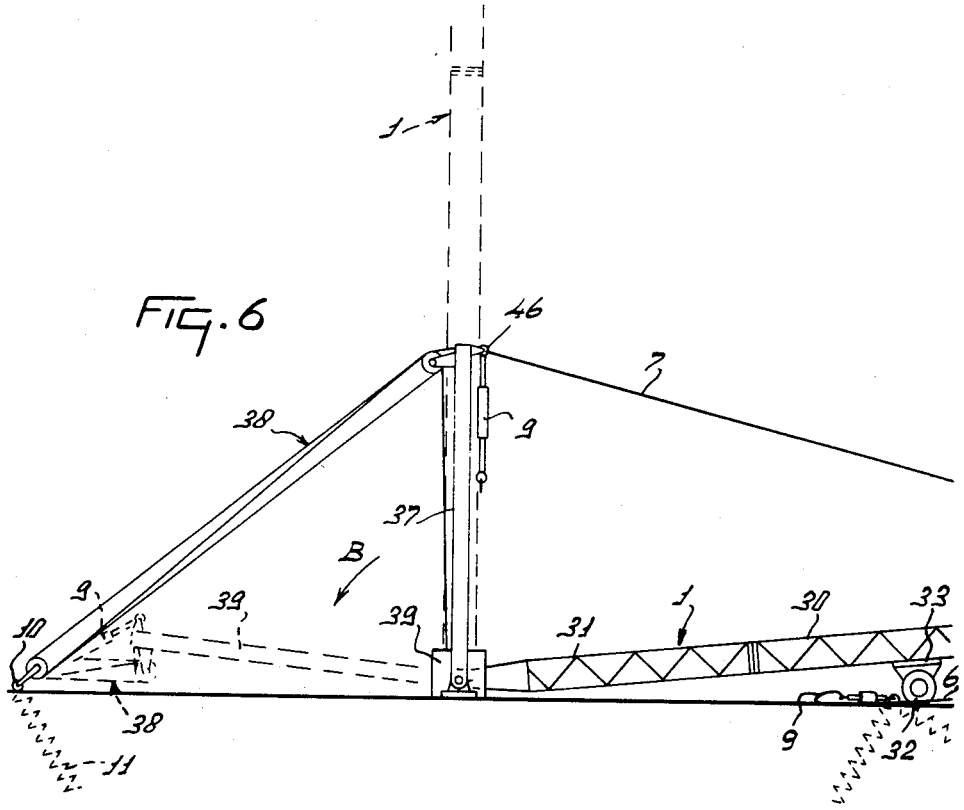
Figure 7:
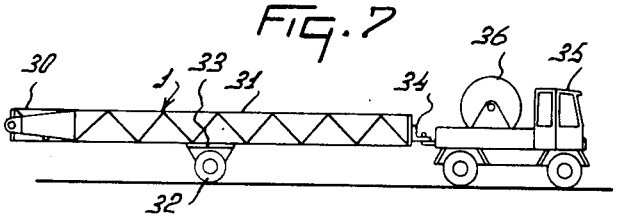
Figure 8:
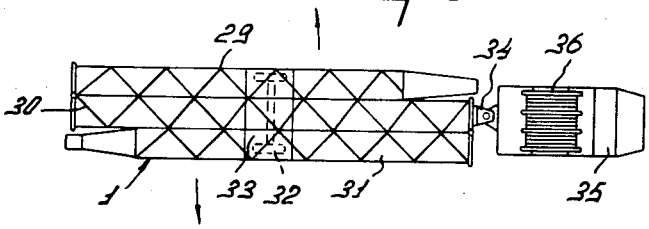

For a better understanding of the invention and to show how the same may be carried into effect, reference will now be made, by way of example, to the accompanying drawings, in which:

FIG. 1 is a schematic side view of a device for erecting a building from prefabricated sections, a building to be erected shown as having substantially reached its intended final height, FIG. 2 is a plan view from above the device as shown in FIG. 2, FIGS. 3 and 4 respectively show on an enlarged scale the top and bottom of a mast of the device of FIGS. 1 and 2, FIG. 3 also showing a trolley, FIG. 5 shows schematically positions of components of the device of FIGS. 1 to 4 before the device is moved into its operational position, FIG. 6 shows on an enlarged scale the coupling of tackle for moving the masts out of the position shown in FIG. 5 into the working position shown in FIGS. 1 and 2, FIG. 7 is a side view showing a mast of the device attached to a towing vehicle, the mast being shown in folded condition for transport purposes and the tractor having equipment for winding-up cables, FIG. 8 is a plan view from above of what is shown in FIG. 7, and FIG. 9 shows a modified form of device having only one mast held in place, in use, by means of stays.

The device shown in FIGS. 1 to 8 serves for erecting a building from prefabricated sections which can be, for example, box-shaped. The device includes two supports disposed in use at a distance from each other and formed by masts 1 of beam structure which are erected outside the foundation 2 of the building to be erected. Each of the masts tapers inwardly at its top and bottom ends and is supported at its lower end by a horizontal stub shaft 3 mounted between supports 2A on a concrete foot 4, each mast thus being pivotable about a horizontal axis at its lower end.

Between the top ends of the masts 1 there extends a guide in the form of a carrying cable 5. Each of the masts 1 also has attached to its top end three stays 6, 7 and 8 disposed so that, as viewed in plan (FIG. 2), the two stays 6 and 7 are in line with each other and at right angles to the cable 5 and the third stay 8 extends at right angles to the stays 6 and 7 and away from, but in line with, the carrying cable 5. Each of the stays 6, 7 and 8 is secured via a tensioning screw 9 and a ring 10 to an anchorage 11 secured at a great depth in the ground.

Adjacent the lower end of each mast 1 a winch mechanism 12 is mounted on the concrete foot 4, a hoisting cable 13 and a draw cable 14 being wound on this mechanism. From the mechanism associated with one mast 1, say the left-hand mast in FIG. 1, the cables 13 and 14 pass around pulleys 15 near the lower end of the mast and through the interior of this mast to the top. At the top of this mast the draw cable 14 passed around a pulley 25 and is fastened to one of two trolleys 17 which can move on rollers 18 along the carrying cable 5. The hoisting cable 13 passes around a pulley 16 at the top of the mast and then, inside the trolley 17 just mentioned, around a first of two pulleys 19 which are spaced apart in this trolley 17. From this first pulley 19 the hoisting cable 13 extends down to a pulley 20, around this pulley, back to the other pulley 19 of the trolley 17, on to top of the other mast 1 (the right-hand mast in FIG. 1) where it is fastened. In similar manner the cables 13 and 14 that extend up the right-hand mast in FIG. 1 pass to the other of the two trolleys 17 and, in the case of the cable 13, on to the top end of the left-hand mast. Each pulley 20 is mounted on a yoke 21 provided with transverse arms 22 with the aid of which prefabricated box-shaped sections 23 can be picked up in a manner not shown in detail. Each hoisting cable 13, pulley 20 and yoke 21 constitutes a hoisting system 24.

It will be seen from FIG. 2 that the yoke 21 extends in the direction of length of a section 23 carried by the hoisting system 24, and that during displacement the section 23 has its direction of length transverse of the direction of displacement. The short sides of the section 23 move parallel to the longitudinal side of the building to be erected. Thus the yoke 21, in conjunction with the provision of steering cables 28, constitute means for maintaining the orientation of section 23 while section 23 is carried by the hoisting system 24.

In the embodiment shown two trolleys 17 move along the carrying cable 5 and whilst the building is being erected each trolley moves from a mast 1 towards the centre and back. In an alternative form only one trolley is provided, the draw cable 14 being prolonged to the opposite mast where it is passed back via a pulley to enable movement of the trolley up to the opposite mast.

The guide 5 formed by the carrying cable extends, as is apparent from FIGS. 1 and 2, near the centre in a substantially horizontal direction of length and over at least the whole length of the building to be erected and it is arranged at a sufficiently high level for erecting the building to its final height.

As is shown in FIG. 1, the sections 23 to be erected can be transported by a well loader to the sides of the masts facing the building, here they can be lifted by the hoisting system 24 from the trailer before the section is displaced in the direction of the carrying cable 5, that is to say in the direction of length of the building to be erected, for disposing the section at its intended destination. It will be appreciated that initially each section need be lifted only over a small height in order to be moved subsequently over a greater or smaller distance in the direction of length of the carrying cable and of the building to be erected by means of the respective trolleys 17. In the building shown in FIGS. 1 and 2 the sections of each storey are each time arranged side by side at the centre, after which the storey is completed from the centre. It will be appreciated that an the building becomes higher the sections have to be lifted over a greater distance. FIG. 1 shows that in the upper storey one section has not yet been arranged in place in order to facilitate the disposition of the roof parts 26.

Each trolley 17 is provided with a remote-control system 27 with the aid of which an operator in charge of arranging the section at its correct place can control the winch systems 12 near the lower ends of the masts 1. There is furthermore provided communication equipment (not shown) formed by a telephone or radio system so that communication with persons on the ground is possible, which is important especially when completing the topmost storey. FIG. 1 shows furthermore that by means of steering cables 28 the operator can perform readjustments during the displacement of a section 23, if necessary.

Although this is not shown, it will be appreciated that instead of using one guide in the form of a carrying cable a plurality of guides in the form of carrying cables may be provided, whilst the or each guide may, as an alternative, be of a different structure for example, a rigid structures.

Transporting and erection of the device described above made up of the two masts 1, the carrying cable 5, the stays 6, 7 and 8 and the respective hoisting and drawing cables 13 and 14 can be carried out rapidly in the following manner. It will be seen from FIGS. 1 and 4 that each of the masts 1 is composed of three portions 29, 30 and 31, which are relatively pivotable to an extent such that they can be folded together as is illustrated in FIGS. 7 and 8. For transport purposes a carrier 33 mounted on ground wheels 32 can be secured centrally beneath the folded mast and a draw eye 34 may be secured to the front end of the central mast portion 30. The draw eye 34 can be coupled with a propelling vehicle 35 which is preferably a van provided with reels 36 on which the cables can be wound.

Before the device can be erected, the concrete supporting feet 4 have to be provided for the masts 1 and the winch systems 12. Also the anchorages 11 have to be provided for fastening the stays 6, 7 and 8. The masts 1, after having been moved to the correct place by the vehicle 35, are uncoupled from the vehicle and the draw eye 34 is removed. The end mast portions 29 and 31 are then turned in the direction of the arrows in FIG. 8 to become in line with the central mast portion in a manner not shown, and are fastened in place with respect to the central portion. The lower end of the mast is arranged between the supports 2A and pivotably connected thereto by means of the stub shaft 3. Then the carrying cable 5 is arranged between the top ends of the masts 1 together with the trolleys 17 and the respective hoisting and drawing cables 13 and 14. The respective stays 6, 7 and 8 are then arranged in place. The stays 8, extending on plan in the direction of length of the carrying cables, are stretched to the desired tension by means of the stretching screws 9. Of the other two stays 6 and 7 one stay, for example, the stay 6 is left slack for the time being, whereas the other stay 7 is connected, by means of a ring 46 to which the tensioning screw 9 is secured, with the top end of a derrick leg 37, which is coupled by means of an auxiliary tackle 38 with the final fastening eye 10 for the stay 7.

It will be apparent from FIG. 6 that the tensioning screw 9 is hanging freely downwards. The auxiliary tackle 38, which forms together with the derrick 37 the mechanism for erecting the mast 1, can be actuated by means of a winch system 39 so that the derrick moves in the direction of the arrow B (FIG. 6), thus moving the mast into the vertical position by means of the stay 6 and, if necessary, an auxiliary cable (not shown), which may be secured to the centre of the mast. When the mast occupies this position, the stay 6 can be loosened from the derrick 37 and, after the tackle 38 is removed, it can be connected with the ring 10 by means of the tensioning screw 9. By means of the screw 9 the correct tension systems 12 are arranged in place near the lower ends of the masts 1 and after these winch systems have connected with them the respective hoisting and drawing cables 13 and 14 the device is ready for use. Dismounting of the device can be carried out in similar manner reversing the order of operations, that is to say, after the stay 6 has been loosened, the derrick 37 with the auxiliary tackle 38 can be put up and the masts can be lowered by turning them about the respective stub shafts 3, after which the various components can be stored and the masts can be folded for loading on the carrier 33 with the wheels 32 for transport.

The device described above for the erection of a building from prefabricated sections can be readily set up and transported and due to its simplicity its costs may be low. Instead of using a drawing cable for each trolley to be actuated from the lower end of a mast, the trolleys may be driven, for example, by an electric motor, which can be controlled by an operator for displacing the trolleys in the direction of length of the guide 5.

FIG. 9 shows an embodiment in which a mast 40 is held in place by stays 39A, the length of this mast being equal to one third of the length of the masts 1 of the embodiment of FIGS. 1 to 8. It bears on a foot 40A. In this embodiment a drawing cable 41 passed along pulleys at the lower and top ends of the mast and connected with a winch system 42 near the foot of the mast can be connected with a section 23 loaded on a well loader, the section being moved to its place via a bridge 43, the height of which is adjustable. The bridge 43 is composed of two portions, the second portion being used for disposing the sections at their places in a third storey. For the disposition in the ground floor a lower bridge (not shown) may be employed.

It will be appreciated that the device shown in FIG. 9 is preferably used for erecting buildings of a lower height than the building shown in the first embodiment. This device can be more readily put up and transported.

Although various features of the devices that have been described and/or illustrated in the accompanying drawings and various steps in the methods that have been described and/or illustrated in the accompanying drawings will be set forth in the following claims as inventive features and steps, it is emphasised that the invention is not necessarily limited to these features and steps and includes within its scope each part of each device that has been described and/or illustrated and each method step that has been described and/or illustrated both individually and in various combinations.

What we claim is:

1. Apparatus for rapidly erecting a building from elongated prefabricated sections which comprises:

two vertically disposed masts;

a substantially horizontal guide means disposed between said masts and connected to the upper aspects thereof, said masts and said guide means being substantially within the same vertical plane at all times during operation thereof, said masts being located on opposite sides of the place selected for the foundation of the building to be erected and within said vertical plane in substantially parallel alignment with the horizontal longitudinal center line of the building to be erected;

each of said masts being located to define adjacent thereof and the place selected for the foundation of the building to be erected a section discharge receiving space, each of said space conforming to the size of the individual prefabricated sections for the building to be erected;

transport means being provided which is adapted to position prefabricated sections for the building to be erected within each said space in the directional orientation they will occupy in the completed building;

a pair of hoisting means each of which comprises a trolley carried by said guide means, elongated flexible extensible means depending from said trolley, and a yoke for supporting said sections connected to said flexible means;

a separate moving means for each of said trolleys whereby each said trolley is independently movable along about at least one-half of said guide means to and from a position directly above a different said defined space;

each of said yokes provided with section orientation maintaining means for performing the function of maintaining the directional orientation of each said section supported by the corresponding yoke;

said hoisting means, including each said trolley and each said yoke, adapted to carry each said section for the building to be erected in a horizontal position and otherwise in an orientation maintained by said orientation maintaining means whereby at all times from when each said section is vertically elevated from either one of said defined spaces until it is placed in the building being erected, its longitudinal axis is substantially horizontal and substantially perpendicular to said vertical plane and its shorter sides move substantially parallel to a longitudinal side of the building to be erected;

one of said trolleys, with its depending said yoke and said hoisting means, adapted to hoist said prefabricated sections from a first of said spaces and to transfer same to their place in the building to be erected and the other said trolley with its depending said yoke and said hoisting means adapted to hoist said prefabricated sections from the second of said spaces and to transfer same to their place in the building to be erected; and control means controlling movement of each said trolley and its corresponding depending said yoke and the corresponding said hoisting means substantially independently of the other said trolley and its depending said yoke.

2. Apparatus in accordance with claim 1, wherein said vertical plane substantially contains the horizontal longitudinal center line of the building to be erected.

3. Apparatus in accordance with claim 1, wherein communication means are provided in the apparatus whereby an operator stationed on the building being erected proximate to where said sections are being moved can communicate with others who control the operations of each said hoisting means on the ground.

4. Apparatus in accordance with claim 1, wherein said control means include first and second remote control means provided for controlling the operation of each said trolley and said hoisting means, said first control means connected to and depending from said first mentioned trolley relative to each section carried thereby and said second remote control means interconnected with and depending from said other trolley relative to each said section carried thereby so that each said control means is directly available to an operator who may be located on a component of the building to be erected proximate the correct place for the section carried by the trolley from which said remote control means depends whereby such operator is enabled to control directly by said remote control means the corresponding said trolley and said hoisting means for independently positioning each said section in its correct place in the completed building.

5. Apparatus in accordance with claim 1, wherein one said hoisting means includes a winch secured near the foot of one of said masts, said flexible means extending from said winch to the top of said masts through the interior of said one mast.

6. Apparatus in accordance with claim 1, wherein said masts are located so as to be at all times completely separated from said building to be erected including the foundation.

7. Apparatus for rapidly erecting a building from elongated prefabricated parallelepiped sections which comprises:

two vertically disposed masts;

a substantially horizontal guide means disposed between said masts and connected to the upper aspects thereof, said masts and said guide means being substantially within the same vertical plane at all times during operation thereof, said masts being located on opposite sides of the place selected for the foundation of the building to be erected and within said vertical plane in substantial parallel alignment with the horizontal longitudinal center line of the building to be erected;

at least one of said masts being located to define between it and the place selected for the foundation of the building to be erected a section discharge receiving space conforming to the size of the prefabricated sections for the building to be erected;

transport means adapted to position prefabricated sections for the building to be erected within said space in the directional orientation they will occupy in the completed building;

hoisting means which comprises a trolley carried by said guide means, elongated flexible extensible means depending from said trolley, and a yoke for supporting said sections connected to said flexible means;

moving means provided for said trolley whereby it is movable along said guide means to a position directly above said defined space;

said yoke provided with section orientation maintaining means for performing the function of substantially maintaining the directional orientation of each said section supported by the yoke;

said hoisting means, including said trolley and said yoke, adapted to carry each said section for the building to be erected from said defined space in a horizontal position and otherwise in an orientation maintained by said orientation maintaining means whereby at all times from when each said section is vertically elevated from said defined space until it is placed in the building being erected, its longitudinal axis is substantially horizontal and substantially perpendicular to said vertical plane and its shorter sides move substantially parallel to a longitudinal side of the building to be erected;

a remote control means provided for controlling the operation of said hoisting means and said trolley, said remote control means interconnected with and depending from said hoisting means relative to each said section carried thereby and being directly available to an operator who may be located on a component of the building to be erected proximate the correct place for said section therein so that such operator is enabled to control directly by said remote means said hoisting means for efficiently and accurately positioning each said section in its correct place in the completed building.

8. Apparatus in accordance with claim 7, wherein a further trolley is provided to move along said guide means independently of said first mentioned trolley for transferring sections to the building to be erected, both said trolleys being disposed in said vertical plane.

9. Apparatus in accordance with claim 7, wherein communication means are provided in the apparatus so as to be available to an operator who may be located on a component of the building to be erected proximate where said sections are being moved by said moving means whereby he can communicate with others on the ground who control the operations of said trolley including said moving means.

10. Apparatus in accordance with claim 7 comprising a further trolley disposed in said vertical plane and carried by said guide means between said masts, a further section discharging receiving space being provided between said other mast and the place selected for the foundation of the building to be erected for receiving prefabricated sections, a further hoisting means comprising said further trolley, a further elongated extensible means depending therefrom, and a further yoke for supporting said sections connected to said further flexible means, adapted to receive and lift said sections from said further space and to convey them to their place in the building being erected.

11. Apparatus in accordance with claim 10 wherein said guide means comprises a cable carrying both said trolleys.

* * * * *